US005807288A

United States Patent [19]

Wu

[11] Patent Number: 5,807,288

[45] Date of Patent: Sep. 15, 1998

[54] PAD-TYPE ROLLER MASSAGER

[76] Inventor: Dong-Her Wu, No. 141, Sec. 2, Chang Shui Road, Pu Yen Hsiang, Chang Hua, Taiwan

[21] Appl. No.: 876,438

[22] Filed: Jun. 16, 1997

[51] Int. Cl.[6] ..... A61H 15/00

[52] U.S. Cl. ..... 601/99; 601/100; 601/94; 601/102; 601/103; 601/116; 601/126

[58] Field of Search ..... 601/86, 87, 90, 601/94, 98–103, 115, 116, 118, 122, 126

[56] References Cited

U.S. PATENT DOCUMENTS

| | | | |
|---|---|---|---|
| 3,405,709 | 10/1968 | Mathers | 601/52 |
| 3,812,846 | 5/1974 | Trout | 601/116 |
| 4,615,336 | 10/1986 | Fijimoto | 601/99 |
| 5,137,016 | 8/1992 | Yamasaki et al. | 601/116 |
| 5,233,973 | 8/1993 | Gill et al. | 601/103 |

*Primary Examiner*—Danton D. DeMille
*Attorney, Agent, or Firm*—Beveridge, DeGrandi, Weilacher & Young LLP

[57] ABSTRACT

A pad type roller massager comprising an upper supporting bracket and a lower supporting brackets, an upper bracket cover and a lower bracket cover, a driving mechanism, a guiding column A, a sliding block, an eccentric motor, a positioning cover for motor, a position controller, a plurality of screws S, and a rollers assembly is provided. The upper and lower supporting brackets are connected by those pair of guiding column which are parallel with each other. A sliding block is moveably attached to the guiding columns and may move upward and downward along the guiding columns. The upper supporting bracket is enclosed with an upper bracket cover and the upper supporting bracket is rotationally disposed with a pulley therein. The lower supporting bracket is also enclosed with a lower bracket cover and the lower supporting bracket is disposed with a worm gear motor which in turn meshed with a worm gear having a pulley formed thereof. A belt is guided via the pulley and the worm gear having pulley. The free end of the belt are fixedly attached to the sliding block. Consequently, when the worm gear motor is rotated, the belt as well as the sliding block is moved upward and downward. The sliding block is further provided with a position controller which can reverse the rotating direction of the worm gear motor when the controller reach to the upper or lower supporting brackets. A plurality of rollers assemblies are carried by the sliding block and which may exert a massaging movement to the muscle when the rollers assemblies are moved along the guiding columns. The sliding block is further provided with an eccentric motor which provides vibration to the sliding block. As a result, the massager is featured with a three dimensional massaging movement.

3 Claims, 8 Drawing Sheets

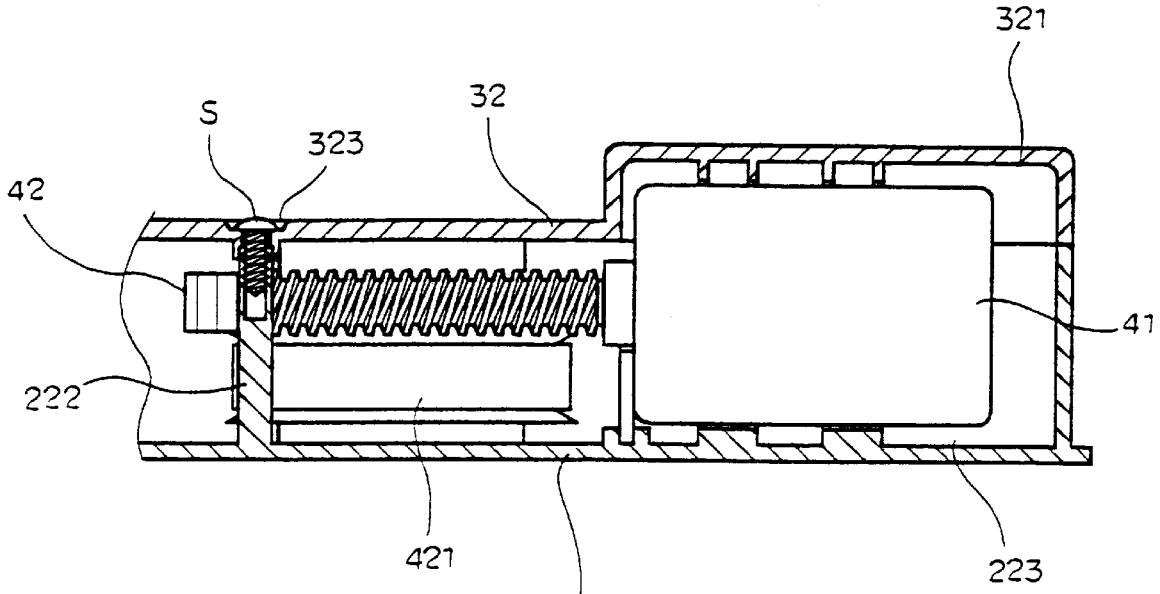
FIG 2 -A 22
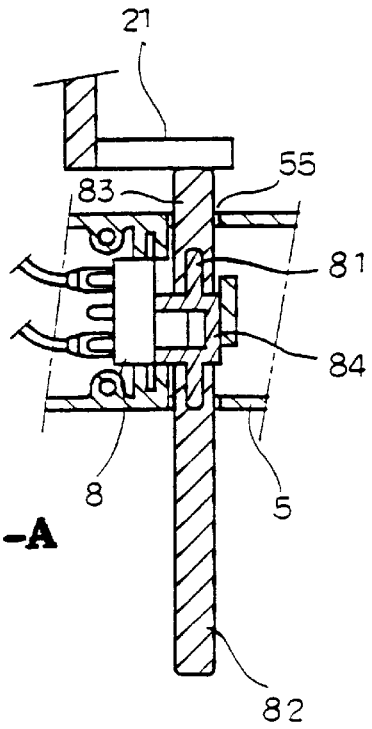
FIG 5 -A
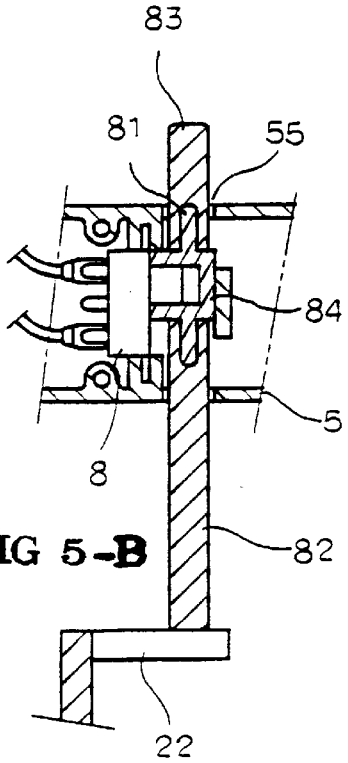
FIG 5 -B

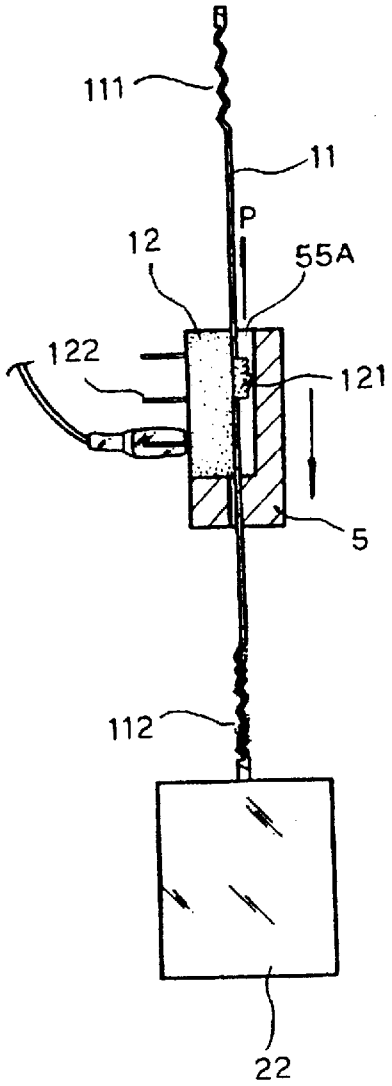
FIG 7 -B
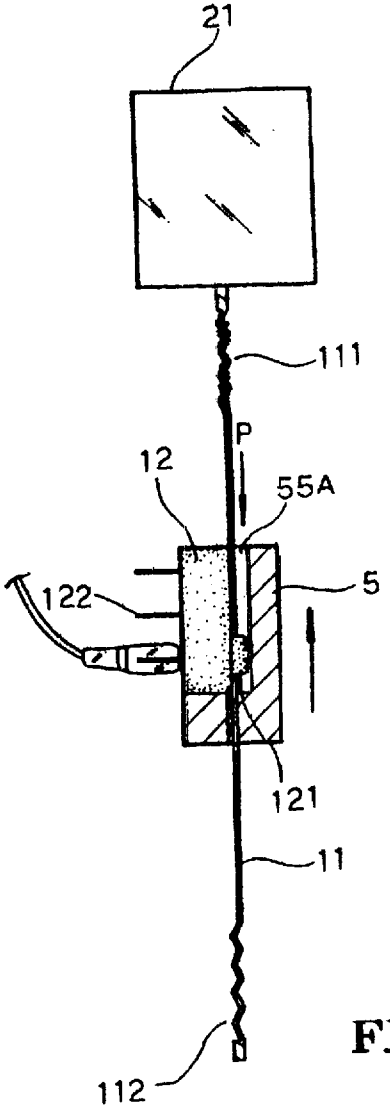
FIG 7 -A

PAD-TYPE ROLLER MASSAGER

FIELD OF THE INVENTION

The present invention relates to a massager, more particularly, to a pad-type roller massager wherein a massaging rollers assembly carried by a sliding block is constantly and periodically moved along a pair of guiding columns by a worm gear motor. The downward and upward movement of the sliding block along the guiding columns are controlled by a position controller wherein the worm gear motor is reversed once the sliding block is reached to the upper supporting bracket or the lower supporting bracket. The sliding block is further provided with an eccentric motor having an eccentric wheel thereof, when the eccentric motor is powered, a vibration is applied to the sliding block as well as the rollers assembly. As a result, the rollers assembly is also provided with three dimensional movement. The rollers assembly is covered with a foam pad which in turn enclosed with a cloth as well as leather.

DESCRIPTION OF PRIOR ART

Our muscles will become tired, painful and strained when the muscles are overloaded, or under tension, or sustained with excess psychological pressure. Normally, the human may get rid of these pain and strain by taking a medicine or a rest. However, taking a massage directly toward the muscle may effectively remove these pain and strain and refresh the muscles.

In the existing massager, it generally comprises an electric motor having an eccentric weight or wheel. The motor can be rotated both in high or low speed via gear sets and a vibration can be generated accordingly. While the motor is rotated, this vibration can be applied to the local muscles. In order to increase the massaging effect, a planar surface having projected bosses or small balls is disposed to the massager. However, the massaging area is limited to those special area covered and accessed effectively by the conventional massager. As a result, the conventional massager can be concluded with the following defects.

1. Poor massaging effect: the conventional massager may only provide a low and high speed vibrations which are resulted from a simple electric motor. As a result, the massaging effect is not perfect as intended. The reason is the circulation of our blood is different from time to time and is also dependent to our emotion. A regular massaging effect is poor as it can not effectively massage the muscles.
2. It is not user friendly. As described above, the conventional massager utilizes a projected bosses or balls to increase the massaging effect. However, as the massaging force is concentrated locally at those projected bosses or balls, the overall area of the user's body can not be completely covered by those projected bosses or balls, especially to a user having longer back. Since the massaging movement is limited locally, the user may only move or change the posture to get the other muscles massaged. On the other hand, the user may only adjusted the operating mode while sitting on it. This is extremely inconvenient to the user and the muscles can not completely relaxed.
3. Excess massaging. In the conventional massager, as the massaging vibration is limited to a certain area, the local area may be painfully suffered if the area is exposed excess massaging movement. Normally, no one can sustain a prolonged massaging movement, especially to a certain area. In light of this, the massaging movement shall be periodically applied and carefully controlled/adjusted, otherwise, the muscles will be injured other than suitably massaged to get off the strain. This is often happened to the older people.

Normally, the conventional massager is provided with a position controller which can be categorized into 1) voltage loaded type, and 2) microswitch type. The detailed description of those two types will be described as follow.

1. Voltage loaded type. This is embodied with a switch in which the user may press or move the triggering button, as a result, the supplied current is varied and the massaging element can be moved. This switch has a step configuration in which the switch is controlled step by step. This is especially inconvenient to the user for a prolonged massaging movement. Even the muscle can be suitably massaged, the hand which is used to control the switch will become tired. Furthermore, the user needs to change the position of the switch immediately after one movement is ended, only by this a complete and overall massaging movement can be attained. If the massaging element is not moved, the massaging movement will cause a painful pressure to the muscles if the later is exposed for a prolonged time. If the switch is not changed to next position, then the massaging element will keep on a movement which is set originally. However, the load is increased as the resistance increased. This is often happened to the user when he/she sleeps.
2. Microswitch type. In this supporting bracket of the massager, a limit microswitch is provided. When the massaging element moves to a dead position and reach to the microswitch, the phase of voltage applied to the motor is reversed and the massaging element is caused to move reversely. By the provision of the limit switch, the massaging element can be suitably controlled to cover a certain area defined by the limit switches. However, this microswitch is a sophisticated electronic device which is comparatively expensive. Once the massager is incorporated with this microswitches, the cost is inevitably increased. On the other hand, the sophisticated electronic is sensitive to impact and vibration, once this electronic device is malfunctioned resulted from excess impact or vibration, the movement of the massaging element will loss control. This is a fatal point to the massager having microswitches therein.

SUMMARY OF THE INVENTION

It is the objective of this invention to provide a massager in which the conventional problems can be completely solved.

It is the objective of this invention to provide a pad type roller massager wherein a massaging rollers assembly carried by a sliding block is constantly and periodically moved along a pair of guiding columns by a worm gear motor. The downward and upward movement of the sliding block along the guiding columns are controlled by a position controller wherein the worm gear motor is reversed once the sliding block is reached to the upper supporting bracket or the lower supporting bracket. The sliding block is further provided with an eccentric motor having an eccentric wheel thereof, when the eccentric motor is powered, a vibration is applied to the sliding block as well as the rollers assembly. As a result, the rollers assembly is provided with three dimensional movement. The rollers assembly is covered with a foam pad which in turn enclosed with a cloth as well as leather.

It is still the objective to provide a pad type roller massager wherein the rollers assembly carried by the sliding block has a rugged rim surface which exert an effective massaging movement to the skin as well as the muscles of the user. Furthermore, the massaging movement exerted by the rollers is indirectly applied to the muscles/skin as a foam pad/leather is disposed thereof.

It is still the objective of this invention to provide a pad type roller massager wherein the moving direction of the sliding block along the guiding columns is suitably controlled by a position controller. The position controller features a simple configuration with durable and effective function. As a result, the overall configuration of the massager can be therefore simplified.

According to one aspect of the present invention, the sliding block is firmly and accurately supported by a pair of guiding columns. As a result, the sliding block is firmly, smoothly moved upward and downward along the guiding columns. By this arrangement, the contact between the rollers assembly and the muscle is even and uniform.

According to one aspect of the massager made according to the present invention, wherein the position controller can be configured by providing a slot at the mounting recess of the sliding block and in which a switch triggering plate can be inserted into the slot. The end portions of the triggering plate are provided with a folded portions. The triggering plate further includes a square opening in the central portion. A microswitch is fixedly attached to the inner portion of the slot such that the triggering button is retained within the square opening of the triggering plate. Wherein when the triggering plate is disposed vertically as it is inserted within the slot, the folded portions are projected over the slot respectively with a preset distance. When the folded portion reaches the upper or lower supporting brackets, the folded portion is stopped and generated with a spring force. The triggering button will be moved by the square opening of the triggering plate. As a result, the worm gear motor is reversed and the sliding block is reversed as well. With this simplified mechanism, the moving direction of the sliding block can be suitably controlled.

According to another aspect of the massager made according to the present invention, wherein the triggering plate of the position controller can be replaced by an integrally molded trigger having a middle position block in the central square opening. Both ends of the trigger are formed with a stepped portions in which a compressed spring is enveloped thereof. Wherein when the compressed spring is extended, the overall length is longer than the stepped portions. Wherein when the top portion of the compressed spring is reached to the upper supporting bracket or lower supporting bracket, the compressed spring may exert a force to the trigger such that the triggering button is moved by the square opening. Wherein when the triggering button is moved, the rotation of the worm gear motor is reversed and the belt is also reversed accordingly, by this arrangement, the upward and downward movement of the sliding block is accurately controlled.

BRIEF DESCRIPTION OF DRAWINGS

In order that the present invention may more readily be understood the following description is given, merely by way of example with reference to the accompanying drawings, in which:

FIG. 2A is a schematic illustration showing the positioning of the worm gear motor;

FIG. 5A is a schematic illustration showing the position controller is reached to the upper supporting bracket;

FIG. 5B is a schematic illustration showing the position controller is reached to the lower supporting bracket;

FIG. 7A is a schematic illustration showing the position controller is triggered to move upward;

FIG. 7B is a schematic illustration showing the position controller is triggered to move downward;

DETAILED DESCRIPTION OF PREFERRED EMBODIMENT

Figure 1:
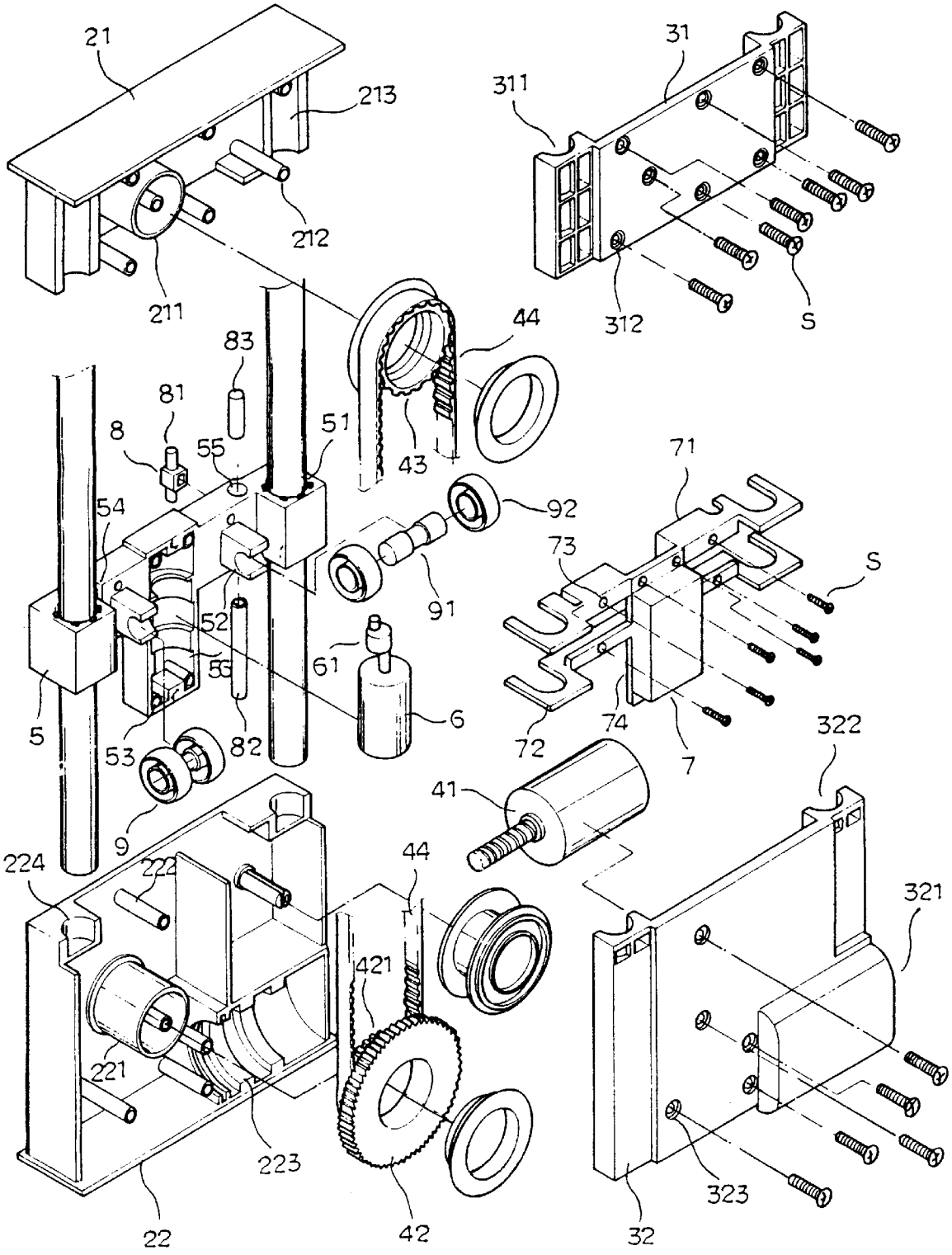
FIG. 1 is an exploded perspective view of the massager made according to the present invention.

Referring to Figures, the massager made according to the present invention comprises an upper supporting bracket 21 and a lower supporting brackets 22, an upper bracket cover 31 and a lower bracket cover 32, a driving mechanism 4, a guiding column A, a sliding block 5, an eccentric motor 6, a positioning cover for motor 7, a position controller 8, a plurality of screws S, and a rollers assembly 9.

The upper supporting bracket 21 has an open configuration having a bushing 211 and a plurality of rods 212 having threaded portion thereof. The left and right sides of the upper supporting bracket are provided with circular grooves 311 respectively. The inner wall of the upper supporting bracket 21 is provided with circular groove 213 at both sides respectively. The upper bracket cover 31 is provided with a plurality of openings in which a plurality of screws can be used to attach the upper bracket cover 31 to the upper supporting bracket 21. The lower supporting bracket 22 has also an open configuration having a bushing 221, a plurality of rods 222 having threaded portion thereof and a positioning circular groove 223. The left and right top portions of the lower supporting bracket 22 are provided with a circular groove 224 thereof respectively. The lower bracket cover 22 can be readily attached to the lower supporting bracket 22 and it is provided with a positioning circular groove 321 corresponding to the lower supporting bracket 22 and a pair of left and right circular grooves 322 at top respectively. The lower bracket cover 32 is provided with a plurality of openings 323 in which a plurality of screws can be utilized to attach the lower bracket cover 32 to the rods 222 of the lower supporting bracket 22. Those two guiding columns A are vertically disposed and parallel with each other. The end portions of the guiding columns A are respectively attached to the circular grooves 213, 224 of the upper and lower supporting brackets 21, 22. A sliding block 5 having a left and right shaft holes 51 are moveably attach to the guiding columns A by those shaft holes 51. The sliding block 5 a pair of rollers mounting socket 52 spaced apart from each other.

The sliding block 5 further includes a plurality of threaded openings 53 and a cutout 54 for fixing a belt thereon. A mounting recess 55 for fixing the position controller 8 is provided within the sliding block 5. The central portion of the sliding block 5 is provided also with a mounting cell 56 for the eccentric motor 6. The motor positioning cover 7 is composed by an upper clipping plate 71 and a lower clipping plate 72 which can be fixedly attached to the sliding block 5. The motor positioning plate 7 is provided with a plurality of openings 73 which are in align with the threaded openings 53. By this arrangement, the plate body 74 of the positioning plate 7 can be attached to the mounting cell 56. The driving mechanism 4 includes a worm gear motor 41, a worm gear 42, a pulley 43, and a teeth belt 44. The worm gear 42 forms a pulley 421 at the face and is rotationally attached to the bushing 221 of the lower supporting bracket 22. This worm gear 42 is meshed with the worm gear motor 41 which is installed at the positioning circular groove 223. The pulley 43 is rotationally mounted to the bushing 211 of the upper supporting bracket 21. On the other hand, the end portion of the belt 44 is fixedly attached to the cutout 54 of the sliding block 5. When the belt 44 forms a loop, the belt 44 is respectively guided by the upper and lower pulleys 43 and 421. The position controller 8 is disposed within the mounting recess 55 of the sliding block 5. The position controller 8 includes a joint 81 to connect the long rod 82 and a short rod 83 for triggering a microswitch by the end portions of the long rod 82 and short rod 83. The microswitch is electrically connected to the worm gear motor 41. A rollers assembly 9 includes a roller shaft 91 having a pair of rollers 92 rotationally mounted at both sides. The roller shaft 91 can be fixedly attached to the roller mounting socket 52 of the sliding block 5. The eccentric motor 6 is a driving motor having an eccentric wheel 61 fixedly mounted at the output shaft. When those above described components are assembled, a foam pad 10 having a central recess 101 is attached thereof. This foam pad 10 can further be enclosed by a cloth B (or leather). Finally, a backrest for massager is formed, referred to FIGS. 1, 2, and 2A.

Furthermore, when the worm gear motor 41 is rotated, the worm gear 42 is driven to rotate also. As the worm gear 42 is rotated, the belt 44 is also moved along the pulleys 42 and 421, consequently, the sliding block 5 is also moved by the rotating belt 44. When the belt 44 rotates clockwise, the sliding block 5 is moved downward and when the long rod 82 of the position controller 8 is reached to the lower supporting bracket 22, the resistance resulted therefrom may switch the microswitch 84 is reversely triggered, as clearly shown in FIG. 5B. Consequently, the rotating direction of the worm gear motor 41 is reversed. Consequently, the sliding block 5 is moved upward as the belt 44 rotated counterclockwise. Then the sliding block 5 will keep moving till the short rod 83 of the position controller 8 reaches to the upper supporting bracket 21. Then the microswitch 84 is reversely triggered again such that the belt 44 is moved clockwise as the worm gear motor 41 is reversed again, as clearly shown in FIG. 5A.

Figure 3:
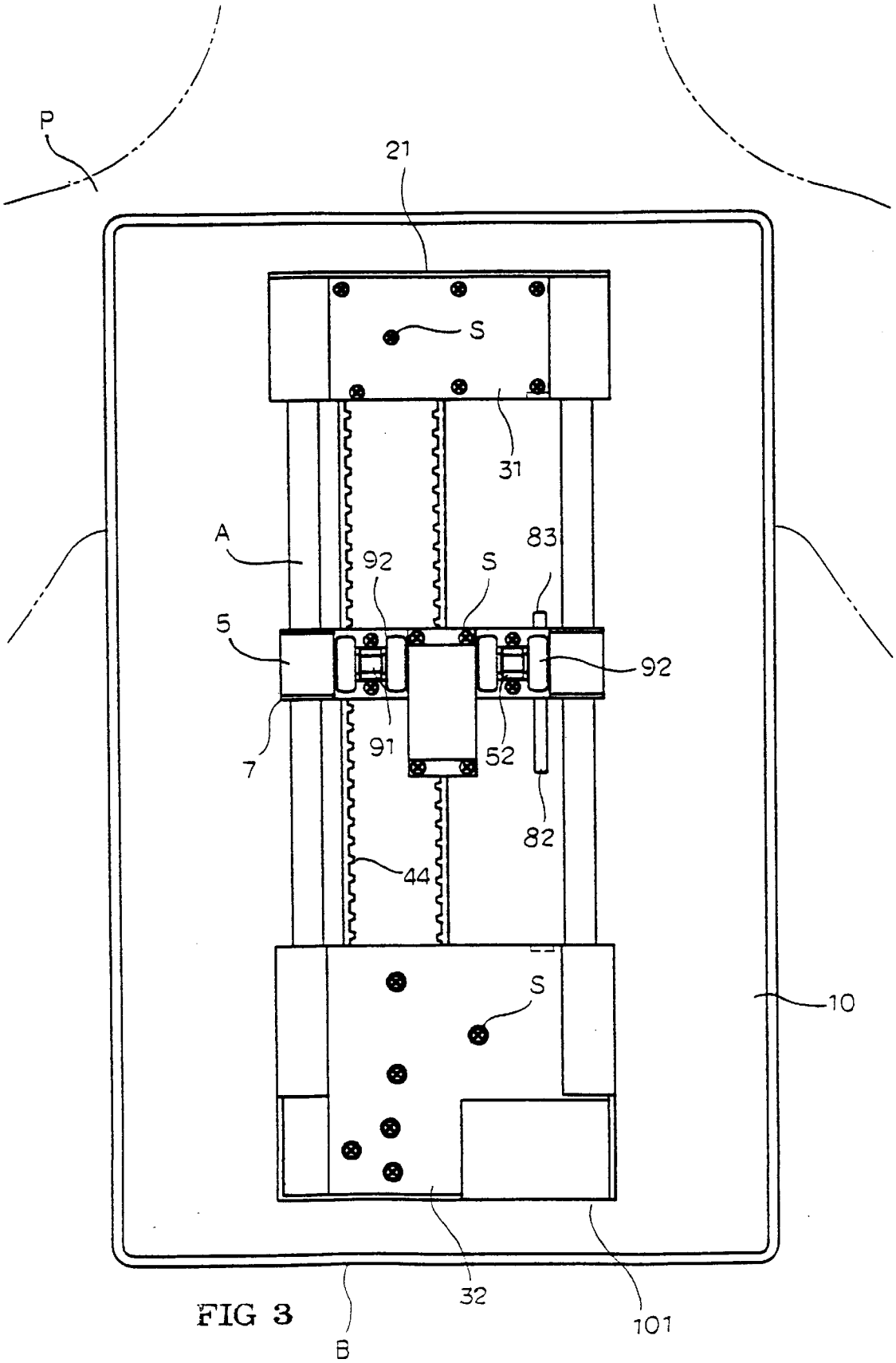
FIG. 3 is a schematic illustration showing the operation of the massaging seat.
Figure 4:
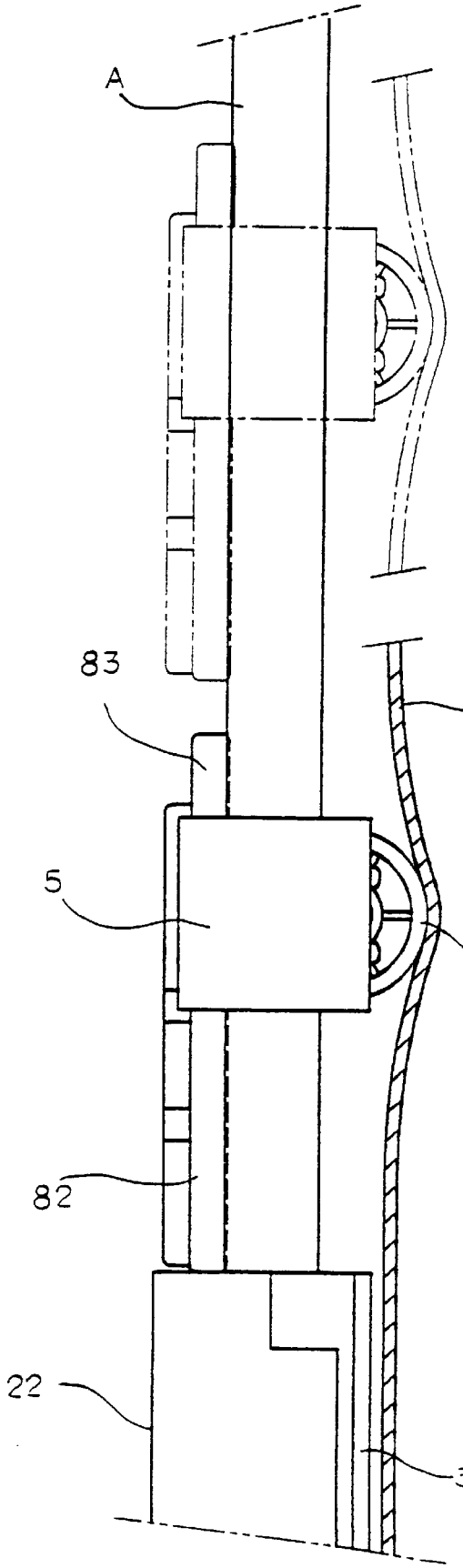
FIG. 4 is a schematic illustration showing the massaging movement of the massager made according to the present invention.

During the movement of the sliding block 5, the eccentric motor 6 is also rotated such that a vibration is provided to the sliding block 5. In light of this, when the sliding block 5 is moved upward and downward along the guiding columns A, the rollers assembly 9 may exert a massaging movement toward the muscles along the spine of a user. By this arrangement, a three dimensional massaging effect to the muscles can be attained. On the other hand, during the upward and downward movement of the sliding block 5, the rollers assembly 9 is closely contacted with the back of the user despite the length of the back of the user. Accordingly, the muscles at back of the user can be completely massaged, as clearly shown in FIGS. 3 and 4.

Figure 2:
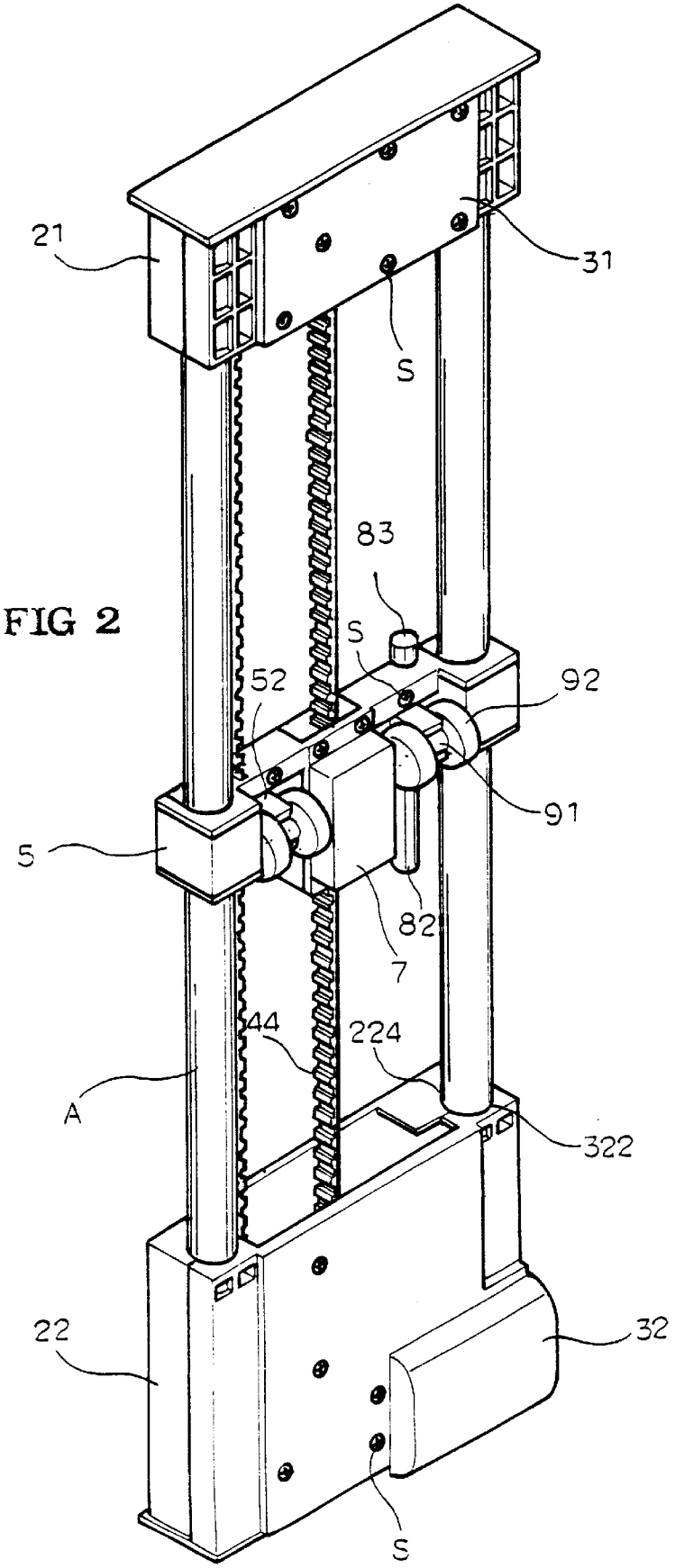
FIG. 2 is a perspective view of the massager made according to the present invention.
Figure 6:
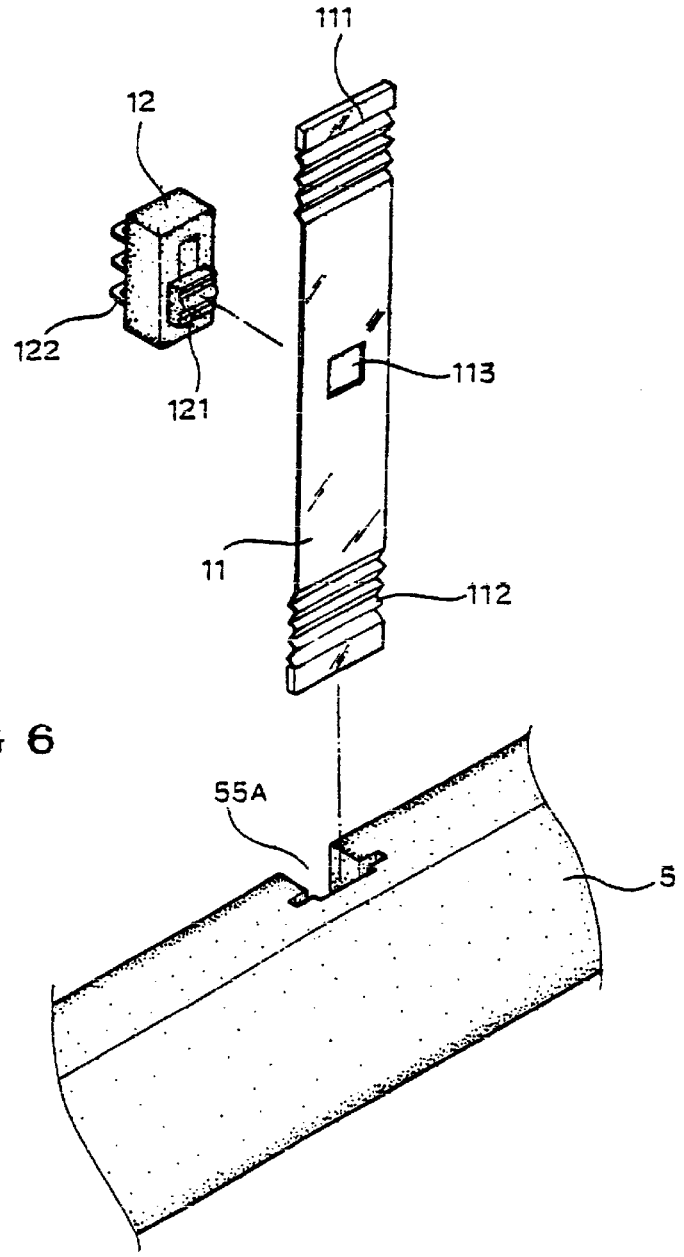
FIG. 6 is an exploded perspective view of the position controller.

Besides, the position controller 8 can be designed according to the following and the resulted position controller 8 may perform the upward and downward movement automatically, referring to FIGS. 1, 2 and 6.

Figure 8:
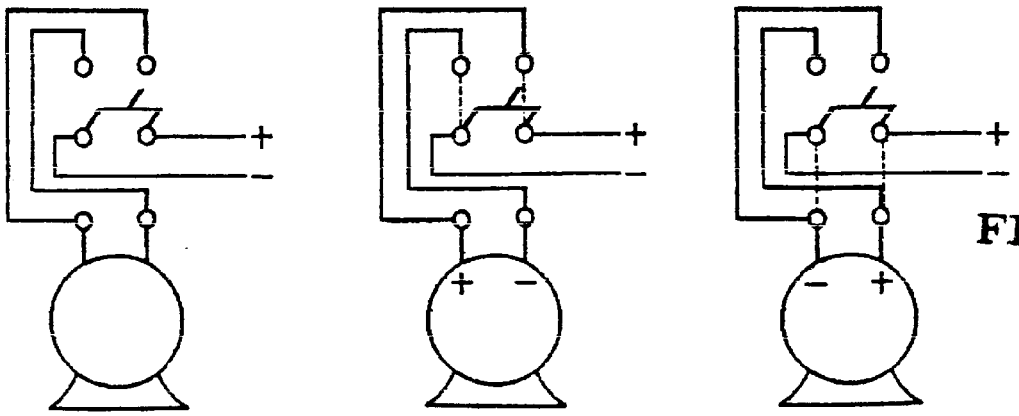
FIG. 8 is a schematic illustration of the operation of the position controller in which the switch can be positioned and selected between a first position wherein the sliding block is moved toward a first direction and a second position in which the sliding block is moved toward a second direction which is opposite to the first position.

The mounting recess 55 of the sliding block 5 can be provided with a slot 55A in which a switch triggering plate 11 can be inserted into the slot 55A. The end portions of the triggering plate 11 are provided with folded portions 111, 112. The triggering plate 11 further includes a square opening 113 in the central portion. A microswitch 12 is fixedly attached to the inner portion of the slot 55A such that the triggering button 121 is retained within the square opening 113 of the triggering plate 11. Accordingly, when the triggering plate 11 is disposed vertically as it is inserted within the slot 55A, the folded portions 111 and 112 are projected over the slot 55A respectively with a preset distance. The conductive plate 122 is connected to the worm gear motor 41 via conductive wires (not shown). The rotating direction of the worm gear motor 41 is controlled by the triggering button 121 of the microswitch 62. In light of this, when the microswitch 62 is closed to different position, the worm gear motor 41 is rotated with different direction, i.e. clockwise or counterclockwise, as clearly shown in FIG. 8. This microswitch 62 is available from the local market, not further detailedly description will be given.

Referring to FIGS. 7A and 7B, when the worm gear motor 41 rotates counterclockwise, the belt 44 is driven as rotated by the worm gear 42. As a result, the sliding block 5 is moved upward by the belt 44. When the triggering plate 11 is reached to the bottom of the upper supporting bracket 21, the sliding block 5 is stopped and a resistance P is exerted to the upper folded portion 111. As a result, the triggering button 121 is moved downward by the square opening 113, as clearly shown in FIG. 7A. By this arrangement, the microswitch 62 is moved to another position such that the phase of the voltage applied to the worm gear motor 41 is reversed. As a result, the belt 44 is moved downward as driven by the worm gear 42 and the sliding block 5 is moved downward accordingly. When the lower folded portion 122 of the triggering plate 12 is reached to the lower supporting bracket 22, the resistance P will switch the triggering button 121 to another position, as shown in FIG. 7B. As a result, the sliding block 5 is moved upward again as the worm gear motor 41 is reversed. By this arrangement, the rollers assembly 9 may constantly and periodically apply massaging movement toward the muscles along the spine.

Figure 9:
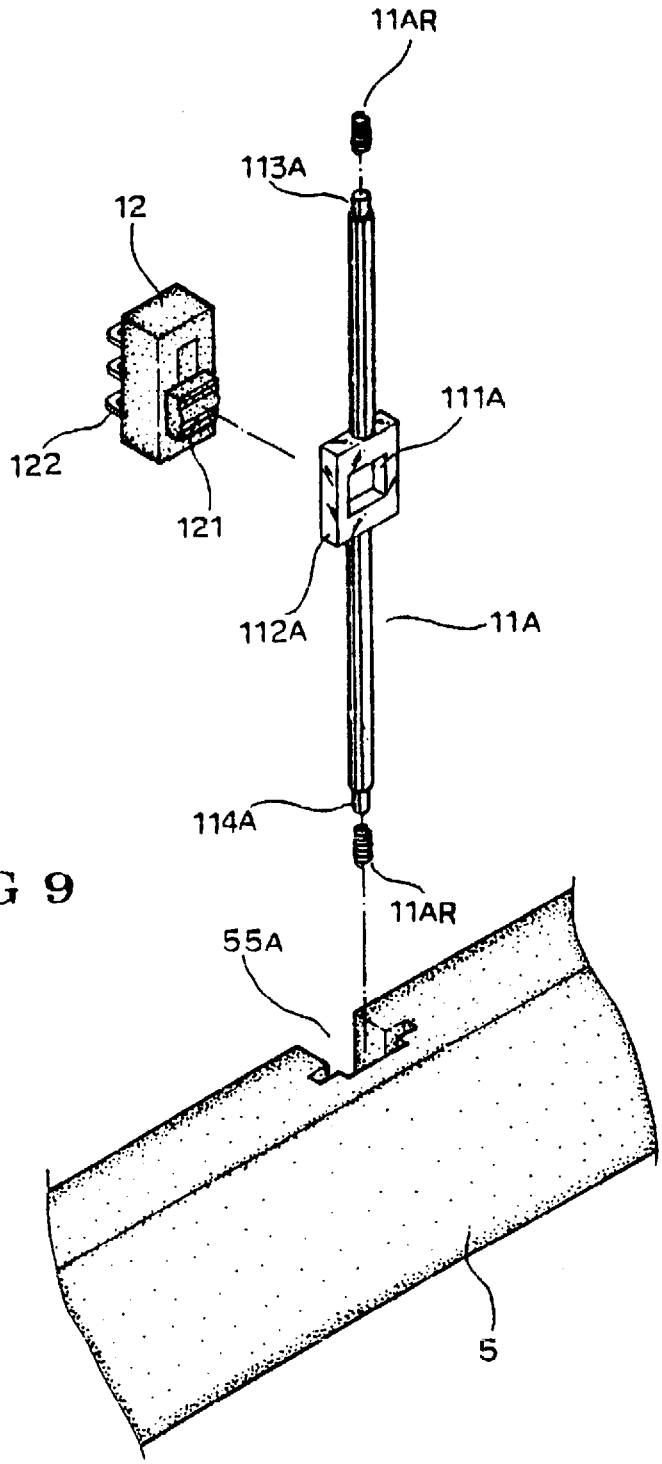
FIG. 9 is a perspective view of another embodiment of the position controller.

Furthermore, referring to FIG. 9, the triggering plate 11 can be replaced by an integrally molded trigger 11A having a middle position block 112A in the central square opening 111A. Both ends of the trigger 11A is formed with a stepped portions 113A and 114A in which a compressed spring 11AR is enveloped thereof. When the compressed spring 12AR is extended, the overall length is longer than the stepped portions 113A and 114A. When the top portion of the compressed spring 11AR is reached to the upper supporting bracket 21 or lower supporting bracket 22, the compressed spring 11AR may exert a force to the trigger 11A such that the triggering button 121 is moved by the square opening 111A. When the triggering button 121 is moved, the rotation of the worm gear motor 41 is reversed and the belt 44 is also reversed.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A pad-type roller massager, comprising an upper supporting bracket having an open configuration, said upper supporting bracket being provided with a bushing and a pair of threaded rods thereof, the left and right side portions of said supporting bracket being provided with circular grooves respectively;

an upper bracket cover being provided with left and right circular grooves therein, said upper bracket cover being provided with a plurality of openings in which a plurality of screws can be applied to attach said upper bracket cover to said upper supporting bracket;

an lower supporting bracket having an open configuration, said lower supporting bracket being provided with a bushing and a pair of threaded rods thereof, the left and right top portions of said supporting bracket being provided with circular grooves respectively;

a lower bracket cover which can be fixed attached to said lower supporting bracket having a positioning circular grooves corresponding to said lower supporting bracket, said lower bracket cover being provided with left and right circular grooves, a plurality of openings being provided such that said lower bracket cover can be attached to said lower bracket cover via a plurality of screws which are fixed to said threaded rod of said lower supporting bracket;

a pair of guiding columns being disposed parallel with each other, the end portions of said guiding columns being retained and positioned to said circular grooves of said upper and lower supporting brackets;

a sliding block having a pair of shaft holes in which said guiding columns can pass through, said sliding block being provided with a plurality of roller mounting socket, a plurality of threaded holes and a cutout in which a belt can be fixedly attached thereof being provided within said sliding block, said sliding block being also provided with mounting recess for installing a position controller therein, a mounting cell for an eccentric motor being also provided centrally in the central portion of said sliding block;

a motor positioning plate including a upper clipping plate and a lower clipping plate which are fixedly attach to said sliding block, said positioning cover being provided with a plurality of openings which are in align with the threaded opening of said sliding block, said positioning plate being fixedly attached to said sliding block;

a driving mechanism including a worm gear motor, a worm gear, a pulley, and a teeth belt, said worm gear being formed with a pulley and rotationally disposed within said bushing of said lower supporting bracket, said worm gear being meshed with said worm gear motor, said pulley being rotationally disposed with said bushing of said upper supporting bracket, the free end of said belt being fixedly retained within said cutout of said sliding block and being routed and guided via said pulleys;

a position controller being mounted within said mounting recess of said sliding block, said positioning controller including a joint connecting thereof a long rod and a short rod in which the free ends of said long rod and short may trigger a microswitch such that the rotating direction of said worm gear motor is reversed as said microswitch is moved;

a roller assembly including a roller shaft having a pair of rollers rotationally mounted at both ends, said roller shaft being fixedly attached to said mounting socket of said sliding block;

an eccentric motor being disposed within said mounting cell of said sliding block, the output shaft of said eccentric motor being provided with an eccentric wheel;

wherein a foam pad is attached to the space between said upper and lower supporting brackets and a cloth or leather is applied to enclose said foam pad; wherein when said worm gear motor is rotated, said sliding block is also triggered to move along said guiding columns as driven by said belt which is in turn driven by said worm gear, wherein when said long rod or short rod is reached to said upper or lower supporting brackets, a microswitch is triggered such that the rotational direction of said worm gear motor is reversed, wherein while said sliding block is moved upward or downward, said eccentric motor is also triggered such that a vibration is applied to said sliding block, by this arrangement, a three dimensional massaging movement is attained.

2. A pad-type roller massager as recited in claim 1, wherein said position controller can be configured by providing a slot at said mounting recess of said sliding block and in which a switch triggering plate can be inserted into said slot, the end portions of said triggering plate are provided with folded portions, said triggering plate further including a square opening in the central portion, a microswitch being fixedly attached to the inner portion of said slot such that said triggering button is retained within said square opening of said triggering plate, wherein when the triggering plate is disposed vertically as it is inserted within said slot, said folded portions are projected over said slot respectively with a preset distance, a conductive plate being connected to said worm gear motor via a conductive wires, the rotating direction of said worm gear motor being controlled by a triggering button of a microswitch, wherein when said microswitch is closed to different position, said worm gear motor is rotated with different direction, i.e. clockwise or counterclockwise, such that said belt is driven upward or downward as driven by said worm gear, consequently, said roller assembly may provide a suitable massaging movement to the user.

3. A pad-type roller massager as recited in claim 2, wherein said triggering plate of said position controller can be replaced by an integrally molded trigger having a middle position block in the central square opening, both ends of the trigger are formed with a stepped portions in which a compressed spring is enveloped thereof, wherein when said compressed spring is extended, the overall length is longer than said stepped portions, wherein when the top portion of said compressed spring is reached to the upper supporting bracket or lower supporting bracket, said compressed spring may exert a force to said trigger such that the triggering button is moved by said square opening, wherein when said triggering button is moved, the rotation of said worm gear motor is reversed and said belt is also reversed accordingly, by this arrangement, the upward and downward movement of said sliding block is accurately controlled.

* * * * *